US007868564B2

(12) United States Patent
Iwata et al.

(10) Patent No.: US 7,868,564 B2
(45) Date of Patent: Jan. 11, 2011

(54) H-MODE DRIFT-TUBE LINAC AND DESIGN METHOD THEREFOR

(75) Inventors: Yoshiyuki Iwata, Chiba (JP); Satoru Yamada, Chiba (JP)

(73) Assignee: National Institute of Radiological Sciences, Chiba (JP)

( * ) Notice: Subject to any disclaimer, the term of this patent is extended or adjusted under 35 U.S.C. 154(b) by 464 days.

(21) Appl. No.: 12/065,145

(22) PCT Filed: Oct. 31, 2005

(86) PCT No.: PCT/JP2005/019990

§ 371 (c)(1),
(2), (4) Date: Feb. 28, 2008

(87) PCT Pub. No.: WO2007/034573

PCT Pub. Date: Mar. 29, 2007

(65) Prior Publication Data

US 2009/0261760 A1 Oct. 22, 2009

(30) Foreign Application Priority Data

Sep. 26, 2005 (JP) ..... 2005-277426

(51) Int. Cl.
*H05H 9/00* (2006.01)

(52) U.S. Cl. ..... 315/505; 315/500; 250/214 VT; 250/396 R

(58) Field of Classification Search ..... 315/3.6, 315/5, 5.34, 5.39, 5.43, 500–505; 250/214 R, 250/214 VT, 207, 396 R; 313/359.1, 361.1
See application file for complete search history.

(56) References Cited

U.S. PATENT DOCUMENTS 3,325,671 A * 6/1967 Symons et al. ..... 315/5.39

(Continued)

FOREIGN PATENT DOCUMENTS

JP 07-263196 10/1995

(Continued)

OTHER PUBLICATIONS

S. Arai, et al., "Performance of the RNB Linac at KEK-TANASHI", Proceedings EPAC98, pp. 770-772, (Aug. 14, 1998), XP-002561730.

(Continued)

*Primary Examiner*—Jacob Y Choi
*Assistant Examiner*—Jimmy T Vu
(74) *Attorney, Agent, or Firm*—Blakely, Sokoloff, Taylor & Zafman LLP.

(57) ABSTRACT

A linearity of a voltage change to a tuner insertion amount is verified for at least one of a plurality of tuners. Based on the voltage change linearity, individual voltage change data corresponding to respective insertion amounts are calculated for each of the plurality of tuners through a proportional calculation. A combination of auto-tuners and a combination of respective insertion amounts of the auto-tuners are determined using the individual voltage change data, and an adequacy of the determined combinations is verified through a direct three-dimensional electromagnetic field calculation. The combinations are determined on a condition that, when the individual voltage change data of nominated tuners are added together, respective voltage changes attributed to the nominated tuners are cancelled out to allow an entire voltage distribution to have substantially no change.

11 Claims, 9 Drawing Sheets

U.S. PATENT DOCUMENTS

| | | | | |
|---|---|---|---|---|
| 4,490,648 | A * | 12/1984 | Lancaster et al. | 315/5.41 |
| 5,334,943 | A * | 8/1994 | Sawada | 315/505 |
| 6,493,424 | B2 * | 12/2002 | Whitham | 378/137 |
| 2005/0029970 | A1 | 2/2005 | Ratzinger et al. | |

FOREIGN PATENT DOCUMENTS

| | | |
|---|---|---|
| JP | 11-273898 | 10/1999 |

OTHER PUBLICATIONS

A.K. Mitra, et al., "RF Test and Commissioning of the Radio Frequency Structures of the TRIUMF ISAC I Facility", Proceedings LINAC02, pp. 106-108, (Aug. 23, 2002), XP-002561729.

European Search Report for European Application No. 05800393.0-1226 containing Communication relating to the Results of the European Search Report, 8 pgs., (Jan. 14, 2010).

PCT International Search Report for PCT Counterpart Application No. PCT/JP2005/019990 containing Communication relating to the Results of the Partial International Search Report, 2 pgs., (Jan. 24, 2006).

Satoshi Yamada, et al., "Integrated Report on Construction of Heavy Particle Beam Cancer Therapy Equipment", National Institute of Radiological Sciences, May 1995, 6 pages.

* cited by examiner

H-MODE DRIFT-TUBE LINAC AND DESIGN METHOD THEREFOR

CROSS REFERENCE TO OTHER APPLICATIONS

This is a National Phase of International Application No. PCT/JP2005/019990, filed on Oct. 31, 2005, which claims priority from Japanese Patent Application No. 2005-277426, filed Sept. 26, 2005.

TECHNICAL FIELD

The present invention relates to an H-mode drift-tube linac which is the type of drift-tube liner accelerator designed to accelerate charged particles by utilizing a TE wave (i.e., H mode) generated inside a resonator, and a design method therefor. In particular, the present invention relates to an auto-tuner selection process for use in the H-mode drift-tube linac design method, and a method of adjusting auto-tuners selected through the auto-tuner selection process.

BACKGROUND ART

A drift-tube linac (i.e., drift-tube linear accelerator) designed to accelerate charged particles by utilizing a transverse electric (TE) wave (i.e., H mode) where a current flows in a direction perpendicular to a beam axis (i.e., an axis of a charged particle beam) is known as an H-mode drift-tube linac. In the H-mode drift-tube linac, a large number of drift tubes are arranged in a cavity resonator along the beam axis in the resonator, and a predetermined voltage is applied between respective adjacent ones of the drift tubes so that particles are accelerated according to the voltage (i.e., potential difference) successively every tine the particles pass through each of the drift tubes.

One type of H-mode drift-tube linac using an interdigital H-mode (IH) resonator is known as an IH linac. The IH resonator typically has a structure in which a pair of upper and lower plates, called "ridges", are mounted (in a vertically opposed arrangement) inside a cylindrical-shaped resonator (although the ridges are not essential to the IH linac). A plurality of drift tubes are alternately attached to the upper and lower ridges through respective stems in such a manner as to be aligned in an axial direction of the resonator. Particles will travel in the axial direction while passing through the drift tubes.

Generally, a linac is equipped with a tuner for adjusting a resonant frequency and a voltage distribution in an entire cavity of a resonator. The finer includes a plurality of fixed tuners and a manually-operated tuner. The fixed tuners are installed in a lateral portion of a wall of a resonator tank and adapted to be used for roughly adjusting the voltage distribution and the resonant frequency. The fixed tuners are immovably welded after the rough adjustment. The manually-operated tuner is adapted to be used for fine adjustment to set a final voltage in the cavity.

During operation of the linac, the resonant frequency is likely to vary due to thermal expansion of the tank and other factor. An auto-tuner is an effective means to compensate or correct such a variation in the resonant frequency caused by temperature change, during the linac operation. Specifically, a slight resonant frequency shift on the side of the tank due to temperature change and other factor is detected by measuring a phase difference between a traveling-wave component in an output of a high-frequency amplifier, and a monitoring signal picked up inside the tank. Then, an automatic frequency control (AFC) circuit performs a calculation based on the measured phase difference to drive the auto-tuner in such a manner as to correct the slight resonant frequency shift.

The H-mode drift-tube linac employs a plurality of tuners, wherein some of the tuners are selectively used as an auto-tuner, and the remaining tuners are used as manually-operated and fixed tuners. The plurality of tuners are arranged in an axial direction of a resonator and along an outer surface of a resonator tank, and each adapted to allow an end member thereof to be inserted into a cavity through a lateral portion of a wall of the resonator tank so as to change a circuit constant of the resonator to modify a resonant frequency or a voltage distribution, as will be described later. Among the tuners, one type configured to change an inductance of the resonator is an inductive tuner, i.e., L tuner, and another type configured to change a capacitance of the resonator is a capacitive tuner, i.e., C tuner.

The auto-tuner is required to have a function of changing only a frequency without changing a voltage distribution. In reality, if one of the tuners is changed in position, a voltage distribution in the entire resonator tends to be changed. It is known that this tendency becomes prominent, particularly, in the IH linac. Thus, two or more of the tuners different in position have to be selectively used as auto-tuners in such a manner that respective voltage changes attributed thereto are cancelled out to keep the voltage distribution from being changed. For this purpose, a three-dimensional electromagnetic field calculation is essential to accurately figure out the voltage distribution, because the voltage distribution in the resonator is dependent on an entire structure of the resonator. However, if the three-dimensional electromagnetic field calculation is performed for each of the tuners while finely changing an insertion amount thereof, to figure out a relationship between a tuner insertion amount and a voltage change, a considerable time has to be spent therefor. As a way for evaluating a combination of tuners suitable for auto-tuners, such a repetitive three-dimensional electromagnetic field calculation is not realistic.

Non-Patent Publication 1: Satoshi YAMADA, et al., "Integrated Report on Construction of Heavy Particle Beam Cancer Therapy Equipment", May/1995, National institute of Radiological Sciences

DISCLOSURE OF THE INVENTION

Problem to be Solved by the Invention

It is an object of the present invention to provide a process of evaluating a combination of tuners suitable for auto-tuners without the need for time-consuming calculation.

It is another object of the present invention to provide a method of designing a linac using auto-tuners selected through the evaluation process, and a linac designed through the design method.

It is yet another object of the present invention to provide a method of adjusting the selected auto-tuners.

Means for Solving the Problem

According to a first aspect of the present invention, there is provided a method of designing an H-mode drift-tube linac utilizing a TE wave (H mode) generated inside a resonator. The method comprises the steps of nominating at least two tuners from among a plurality of tuners arranged along an axial direction of the resonator, and selecting the nominated tuners as auto-tuners through evaluation in terms of whether only a frequency is changed without changing a voltage distribution in the resonator, using a combination of respective positions of the nominated tuners in the axial direction of the resonator and respective insertion amounts of the nominated tuners into the resonator.

Preferably, the step of selecting includes the sub-steps of calculating or measuring individual voltage change data corresponding to respective insertion amounts, for each of the plurality of tuners, based on a given relationship between a tuner insertion amount and a voltage change, and determining a combination of at least two auto-tuner and a combination of respective insertion amounts of the at least two auto-tuner, using the individual voltage change data.

Preferably, the step of selecting further includes the sub-step of verifying the given relationship between a tuner insertion amount and a voltage change.

Preferably, the step of selecting further includes the sub-step of verifying whether the determined combinations are adequate.

In a specific embodiment of the present invention, the given relationship between a tuner insertion amount and a voltage change is a linear relationship between a tuner insertion amount and a voltage change. In this case, the individual voltage change data corresponding to respective insertion amounts, for each of the plurality of tuners, are calculated through a proportional calculation based on the linear relationship.

In another specific embodiment of the present invention, the sub-step of determining a combination of at least two auto-tuners and a combination of respective insertion amounts of the at least two auto-tuners comprises determining the combinations on a condition that, when the individual voltage change data of the nominated tuners are added together, respective voltage changes attributed to the nominated tuners are cancelled out to allow an entire voltage distribution to have substantially no change.

According to a second aspect of the present invention, there is provided an H-mode drift-tube linac utilizing a TE wave (H mode) generated inside a resonator. The linac comprises a plurality of tuners which are arranged along an axial direction of the resonator, and partly used as an auto-tuner, wherein the auto-tuner consists of at least two tuners which are nominated from among the plurality of tuners, and selected through evaluation in terms of whether only a frequency is changed without changing a voltage distribution in the resonator, using a combination of respective positions of the nominated tuners in the axial direction of the resonator and respective insertion amounts of the nominated tuners into the resonator.

Preferably, the linac of the present invention includes insertion-amount adjustment means adapted to adjust respective insertion amounts of the selected at least two auto-tuners without changing a ratio between the respective insertion amounts.

Preferably, the insertion-amount adjustment means includes storage means adapted to store the ratio between the respective insertion amounts of the at least two auto-tuners.

According to a third aspect of the present invention, there is provided an auto-tuner selection process for use in a method of designing an H-mode drift-tube linac utilizing a TE wave (H mode) generated inside a resonator. The process comprises the steps of nominating at least two tuners from among a plurality of tuners arranged along an axial direction of the resonator, and selecting the nominated tuners as auto-tuners through evaluation in terms of whether only a frequency is changed without changing a voltage distribution in the resonator, using a combination of respective positions of the nominated tuners in the axial direction of the resonator and respective insertion amounts of the nominated tuners into the resonator.

According to a fourth aspect of the present invention, there is provided a method of adjusting at least two auto-tuners employed in an H-mode drift-tube linac utilizing a TE wave (H mode) generated inside a resonator, wherein the auto-tuners are selected by nominating at least two tuners from among a plurality of tuners arranged along an axial direction of the resonator, and evaluating the nominated tuners in terms of whether only a frequency is changed without changing a voltage distribution in the resonator, using a combination of respective positions of the nominated tuners in the axial direction of the resonator and respective insertion amounts of the nominated tuners into the resonator. The method comprises adjusting respective insertion amounts of the auto-tuners without changing a ratio between the respective insertion amounts.

Effect of the Invention

In the present invention, at least two tuners are nominated from among a plurality of tuners arranged along an axial direction of a resonator, and evaluated using a combination of respective positions of the nominated tuners in the axial direction of said resonator and respective insertion amounts of the nominated tuners into the resonator, so that a combination of tuners suitable for auto-tuners can be determined in a relatively simple manner. In particular, a combination of two or more tuners which allow respective voltage changes attributed thereto to be cancelled out so as to substantially avoid a change in entire voltage distribution can be determined in a relatively simple manner. In the process of evaluating which combination of tuners is optimal, individual voltage change data corresponding to respective insertion amounts, for each of the plurality of tuners, are calculated based on a given relationship between a tuner insertion amount and a voltage change. This makes it possible to eliminate the need for a three-dimensional electromagnetic field calculation requiring a considerable time for an infinite number of combinations of tuners. Further, in the present invention, respective insertion amounts of the selected auto-tuners are adjusted without changing a ratio between the respective insertion amounts. Thus, a voltage change during the adjustment can be estimated, and a resonant frequency can be corrected while maintaining the voltage change in an allowable range.

BEST MODE FOR CARRYING OUT THE INVENTION

Figure 1:
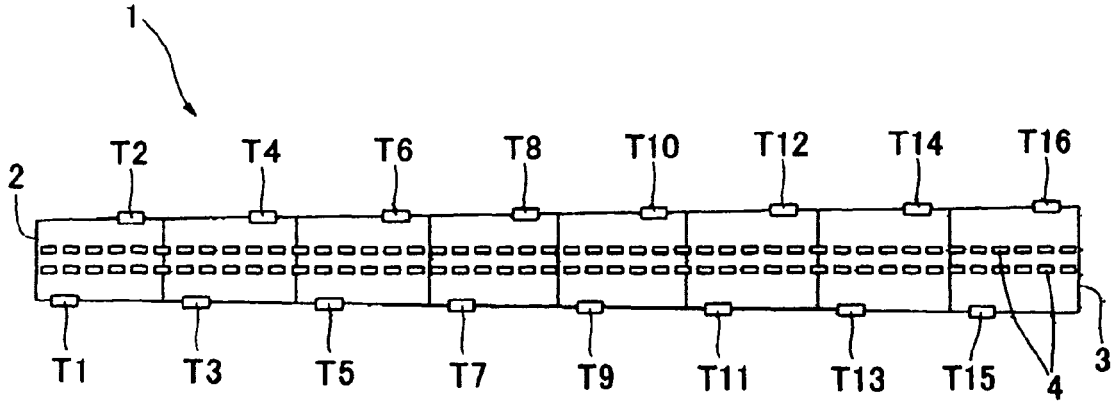
FIG. 1 is a conceptual diagram of an IH-mode drift-tube linac.

The present invention will now be described based on one embodiment thereof where an IH-mode drift-tube linac (IH-DTL) having a resonator provided with sixteen tuners is designed to allow some of the tuners to be finally used as auto-tuners. FIG. 1 is a conceptual diagram of the IH-mode drift-tube linac. This linac has a resonator formed by a tank 1 with a vacuum cavity (i.e., evacuated hollow) structure. The tank 1 is provided with sixteen tuners (tuners T1 to T16) which are arranged axially (i.e., in an axial direction of the resonator) over the range from an inlet end 2 to an outlet end 3 thereof and alternately on right and left sides of an outer surface thereof. Further, the tank 1 is internally provided with a plurality of drift tubes 4 which are aligned along the axial direction.

Figure 2:
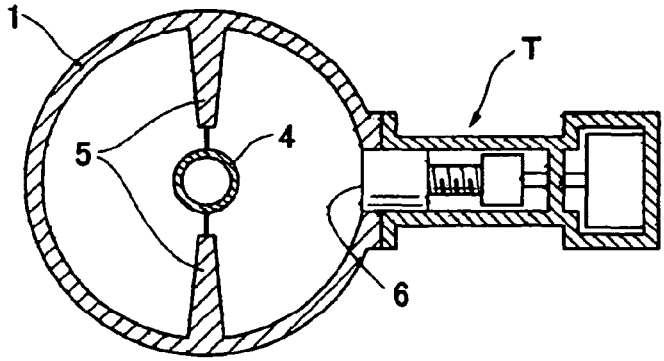
FIG. 2 is a schematic vertical sectional view of a resonator and an inductive tuner, wherein the tuner is at a retracted position.
Figure 3:
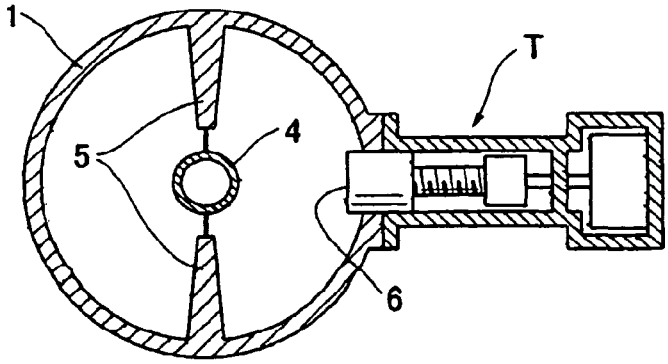
FIG. 3 is a schematic vertical sectional view of the resonator and the inductive tuner, wherein the tuner is at an inserted position.
Figure 5:
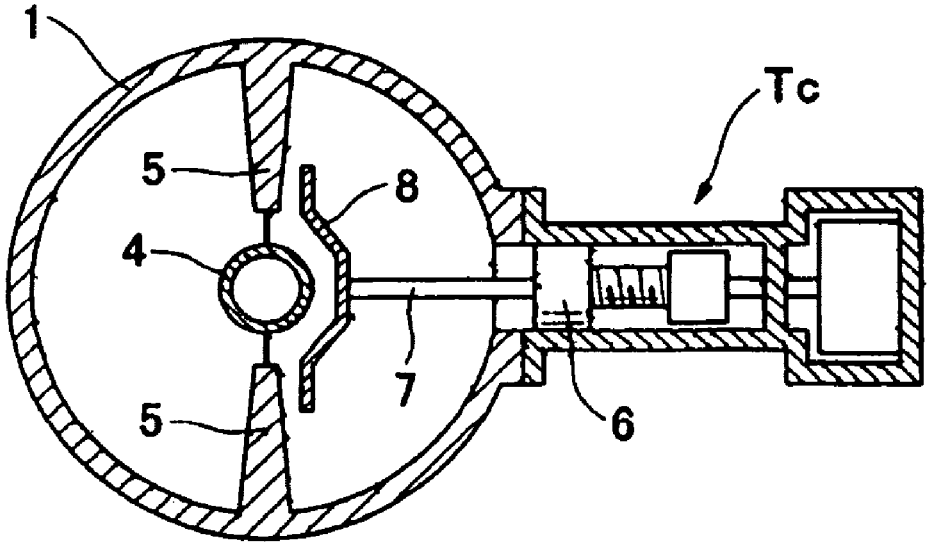
FIG. 5 is a schematic vertical sectional view of a resonator and a capacitive tuner, wherein the tuner is at an inserted position.

FIGS. 2, 3 and 5 are schematic vertical sectional views showing the linac, taken along a direction orthogonal to the axial direction. As shown in FIGS. 2 and 3, each of the drift tubes 4 is mounted to upper and lower regions of an inner surface of a wall of the tank 1 through upper and lower ridges 5. Each of the tuners T is installed in a lateral portion of the wall of the tank 1. Each of the tuners T is adapted to allow an end member 6 thereof to be inserted into a cavity through the lateral portion of the wall of the tank 1. That is, the tuners T1 to T16 in FIG. 1 are structurally the same, but different from each other in position in the axial direction of the resonator.

Figure 4:
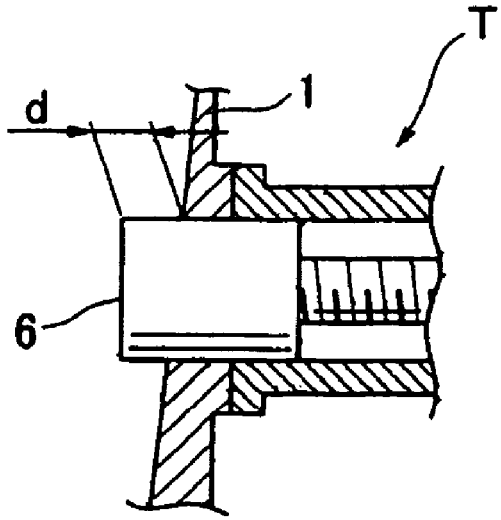
FIG. 4 is a schematic fragmentary horizontal sectional view specifically showing an insertion state of the inductive tuner in FIG. 3.

FIG. 2 shows a state when the end member 6 is not inserted into the cavity, i.e., the tuner T is set at a maximally retracted position. FIG. 3 shows a state after the end member 6 is inserted into the cavity. A distance by which the end member 6 is inserted into the cavity will hereinafter be referred to as "insertion distance d", as shown in FIG. 4. FIG. 4 is a cross-sectional view of a connection portion between the resonator and the tuner, taken along the axial direction of the resonator, which specifically shows a state after the end member 6 of the tuner is inserted into the cavity through the lateral portion of the wall of the tank 1. As shown in FIG. 1, the tank 1 is formed to have an inner diameter which gradually increases in a direction from the inlet end 2 to the outlet end 3. Thus, in a strict sense, respective insertion distances d on an inlet side (upper side in FIG. 4) and on an outlet side (lower side in FIG. 4) are different from each other, as shown in FIG. 4. As used in the following description about the embodiment of the present invention, the term "insertion distance d" means an insertion distance on the outlet side, therethroughout.

A tuner to be used in the present invention may be an inductive tuner or may be a capacitive tuner. The tuner T illustrated in FIGS. 2 to 4 is an inductive tuner (L tuner), and a tuner Tc illustrated in FIG. 5 is a capacitive tuner (C tuner). The capacitive tuner Tc comprises an end member 6, a rod 7 fixed to the end member 6, and a conductive plate 8 fixed to a distal end of the rod 7. The conductive plate 8 is formed and disposed to cover the drift tube 4 and extend up to respective portions of the upper and lower ridges 5. The capacitive tuner Tc is designed to change an insertion amount thereof so that a distance between the conductive plate 8 and each of the drift tube 4 and the portions of the ridges 5, i.e., a capacitance therebetween, can be changed to adjust a voltage distribution or a resonant frequency in the resonator.

Some of the sixteen tuners illustrated in FIG. 1 are used as auto-tuners, and the remaining tuners are used as manually-operated tuners. For this purpose, it is evaluated how many tuners are necessary as auto-tuners, and which combination of tuners is optimal. This evaluation is performed according to the following steps:

(1) A linearity of a voltage change to a tuner insertion amount is verified;

(2) Based on the voltage-change linearity, voltage change data corresponding to respective insertion amounts are calculated for all the tuners, individually;

(3) A combination of auto-tuners and a combination of respective insertion amounts of the auto-tuners are determined using the calculated individual voltage change data; and (4) It is verified whether the determined combinations of auto-tuners and respective insertion amounts of the auto-tuners are adequate, by a direct three-dimensional electromagnetic field calculation.

If a three-dimensional electromagnetic field calculation is performed for each of the sixteen tuners while finely changing an insertion amount thereof, to figure out the relationship between a tuner insertion amount and a voltage change, a considerable time has to be spent therefor. In contrast, when a voltage change has a linear characteristic relative to a tuner insertion amount, voltage changes corresponding to respective tuner insertion amounts can be derived from a voltage change corresponding to a certain tuner insertion amount by a proportional calculation. Thus, in this embodiment, it is first verified whether a voltage change has a linear characteristic relative to a tuner insertion amount. After the verification, a voltage change corresponding to a certain tuner insertion amount is calculated for each of the sixteen tuners. Based on the calculation result, the relationship between a voltage change and a tuner insertion amount in each of the sixteen tuners can be figured out. An auto-tuner is required to have a function of changing only a frequency without changing a voltage distribution, and therefore two or more of the tuners different in axial position have to be selectively used as auto-tuners in such a manner that respective voltage changes attributed thereto are cancelled out to keep an entire voltage distribution from being changed. For this purpose, in this embodiment, respective voltage changes to be caused by inserting the two or more tuners are added to estimate a total voltage change occurring when the tuners are simultaneously inserted. That is, desired auto-tuners are determined based on a combination of two or more tuners and a combination of respective insertion amounts of the two or more tuners. Lastly, a direct three-dimensional electromagnetic field calculation is performed for a model having the two or more tuners simultaneously inserted, to verify whether the determined auto-tuners are adequate.

Although a given relationship between a voltage change and a tuner insertion amount in the present invention is solely described as the linear relationship in the above embodiment, the given relationship in the present invention is not limited to the linear relationship, but may be any other suitable relationship therebetween which allows an operation of acquiring voltage change data based on a three-dimensional electromagnetic field calculation to be omitted. In the above embodiment, the voltage change linearity and the adequacy in the combinations of auto-tuners and respective insertion amounts of the auto-tuners are verified in the steps (1) and (4). These verification steps are not essential to the present invention, and may be omitted. Further, in the above embodiment, the voltage change data is acquired from each of the sixteen tuners (i.e., all the tuners), using the linear relationship between a voltage change and a tuner insertion amount. Alternatively, in the present invention, the voltage change data may be acquired only from some of a plurality of tuners to be subjected to auto-tuner selection (i.e., to be nominated for auto-tuners), instead of all the tuners.

<Verification of Linearity>

Figure 6:
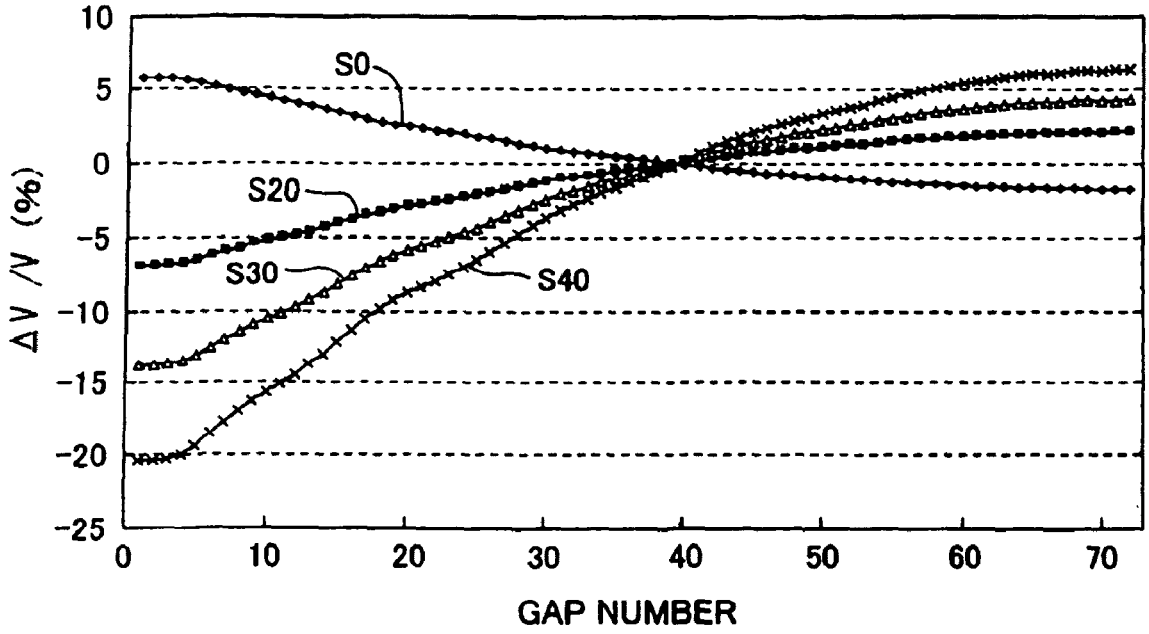
FIG. 6 is a graph showing a relationship between a tuner insertion amount and a voltage change.

In each of the sixteen tuners, it is verified whether the relationship between a voltage change and an insertion amount of the tuner becomes linear when the tuner is gradually inserted into the cavity. More specifically, a three-dimensional electromagnetic field calculation is performed while changing the tuner insertion amount, and calculated voltage values are plotted. In the present invention, the calculation for verifying the linearity may be performed for at least one of a plurality of tuners. The following description will be described about one specific example where this calculation was performed for the tuner T1. In this example, a position where the tuner TI is inserted by 10 mm from a maximally retracted position (see FIG. 2), (i.e., a position where an insertion distance is 10 mm), is defined as a reference position, and a voltage at the reference position is defined as a reference voltage V. FIG. 6 shows plots of voltage changes ΔV occurring when the tuner T1 is inserted and retracted relative to the reference position, wherein the voltage changes ΔV are represented by a percentage with respect to the reference voltage V. Given that an insertion amount from the reference position is X, the following relation is satisfied in this embodiment: d=10+X. It is understood that this reference position is set for data acquisition, and the reference position in the present invention may be set at any other suitable position for data acquisition. In the present invention, the term "insertion amount" generally means the above insertion amount X. The insertion amount X has a positive or negative value. That is, the insertion amount X having a positive value means that the end member of the tuner T1 is inserted from the reference position into the cavity, and the insertion amount X having a negative value means that the end member of the tuner T1 is retracted from the reference position in a direction for moving the end member out of the cavity.

Figure 7:
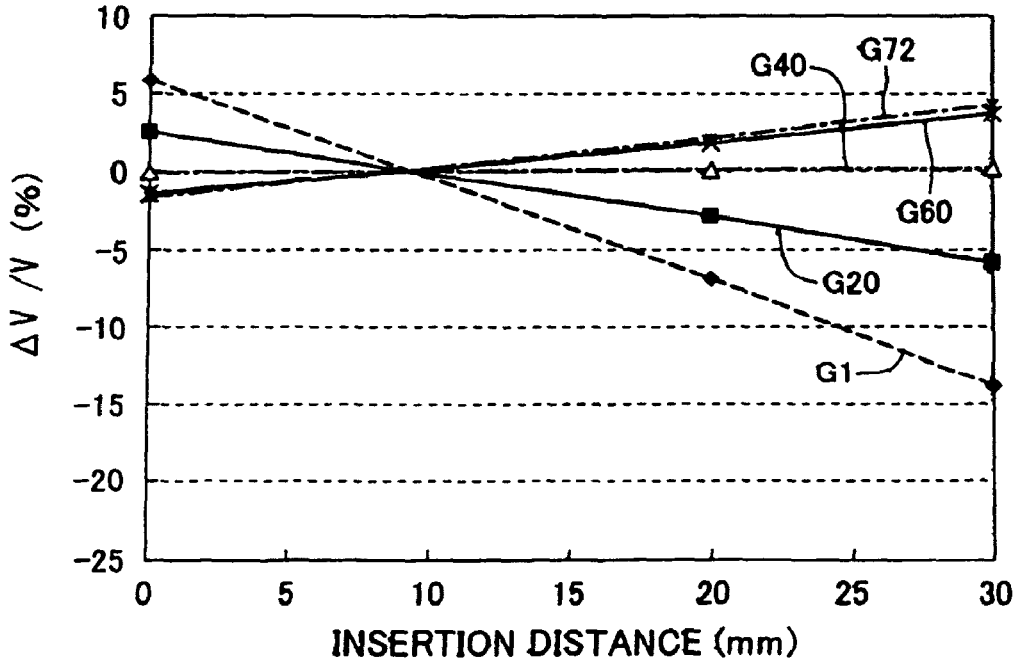
FIG. 7 is a graph showing a relationship between a tuner insertion amount and a voltage change, in representative gaps.

In FIG. 6, the horizontal axis represents a gap number which is assigned to each gap in ascending order from the inlet end, and the vertical axis represents ΔV/V (%). In FIG. 6, curves S0, S20, S30 and S40 indicate voltage changes at insertion distances d=0 mm, 20 mm, 30 mm and 40 mm (insertion amounts=−10 mm, 10 mm, 20 mm and 30 mm), respectively. For more detailed verification, tuner insertion amounts and voltage changes in representative gaps were plotted, as shown in FIG. 7. In FIG. 7, the horizontal axis represents an insertion distance d of the tuner T1, and curves G1, G20, G40, G60 and G72 indicate voltage changes in gap numbers 1, 20, 40, 60 and 72, respectively. As seen in FIG. 7, each of these curves exhibits approximate linearity, and it can be verified that linearity is sufficiently adequate.

<Relationship between Insertion Amount and Voltage Change in all Tuners>

As described above, the linearity of a voltage change to a tuner insertion amount is adequate. This makes it possible to calculate a voltage change corresponding to only a certain tuner insertion amount, and then calculate respective voltage changes corresponding to remaining tuner insertion amounts by a proportional calculation. Specifically, a voltage change at a position having an insertion amount X of 10 mm (insertion distance d of 20 mm) was calculated for each of the sixteen tuners. The result is shown in FIG. 8 (tuners T1 to T8) and FIG. 9 (tuners T9 to T16).

Figure 8:
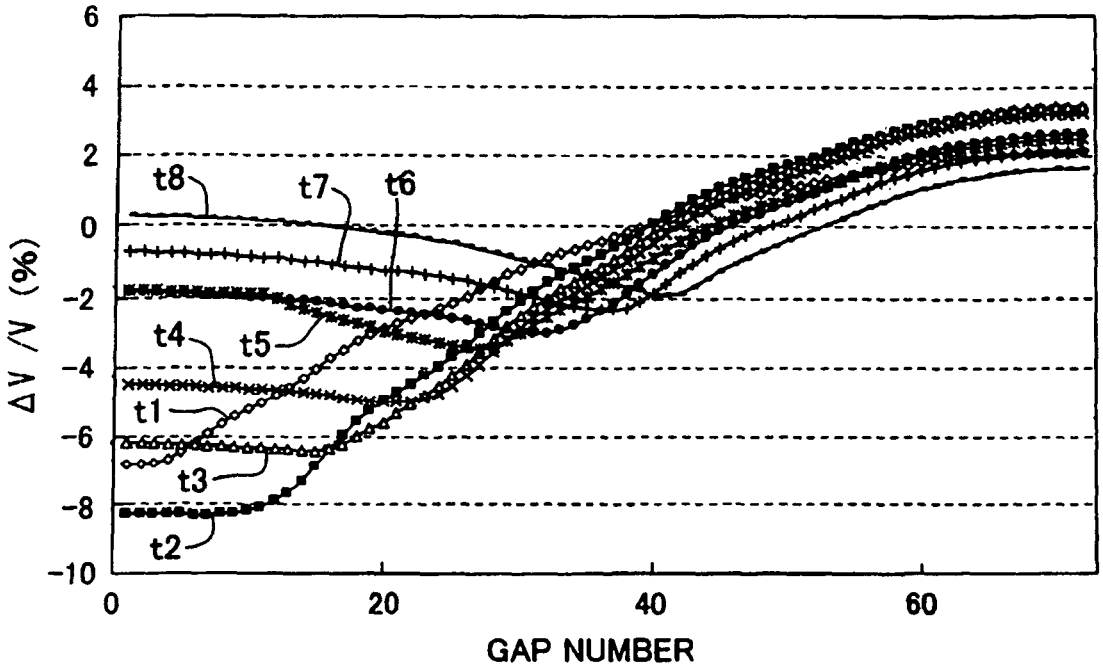
FIG. 8 is a graph showing a voltage change at a position where an insertion distance "d" is 20 mm, in tuners T1 to T8.
Figure 9:
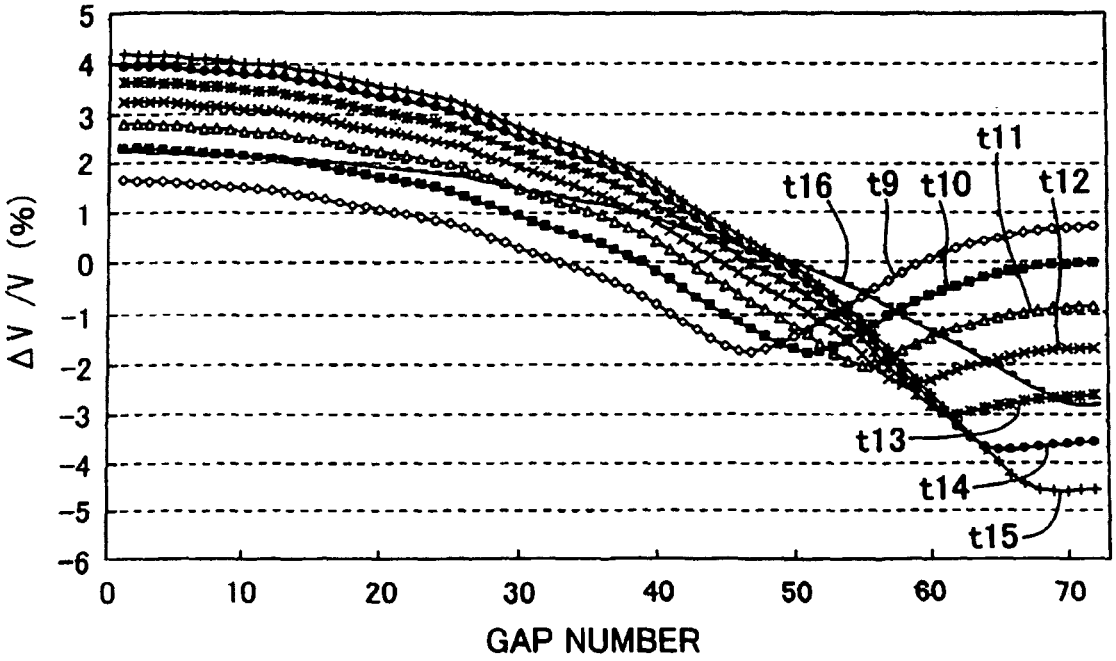
FIG. 9 is a graph showing a voltage change at a position where an insertion distance "d" is 20 mm, in tuners T9 to T16.

In FIGS. 8 and 9, curves t1 to t16 indicate voltage changes in the tuners T1 to T16, respectively. As with a model resonator, a voltage change curve has a wide peak in each of the different tuners, i.e., in each of the tuners which are different in axial position, and therefore a voltage change in each of the tuners has an effect on an entire voltage distribution of the resonator. Thus, two or more of the tuners have to be used as auto-tuners in such a manner as to allow respective voltage changes attributed thereto to be cancelled out.

<Determination of Auto-Tuners and Verification based on Direct Three-Dimensional Electromagnetic Field Calculation>

(1) Combination of Two Tuners

As a first example, two of the tuners are combined to cancel out respective voltage changes attributed thereto so as to eliminate a change in the entire voltage distribution of the resonator. For this purpose, a program-based search was performed to evaluate an optimal combination. Specifically, based on the voltage change curve of each of the tuners illustrated in FIGS. 8 and 9, voltage changes corresponding to respective insertion amounts in each of the tuners were calculated through a proportional calculation with an accuracy controllable by an after-mentioned stepping motor or the like. Then, two of the voltage changes were added together to evaluate a combination providing a minimum voltage change. As a result, a combination of two tuners and a combination of respective insertion amounts of the two tuners which provided a minimum voltage change were satisfied by the tuner T4 and the tuner T12. In this case, a ratio of the insertion amount of the tuner T4 to the insertion amount of the tuner T14 was 6.67:10.00.

Figure 10:
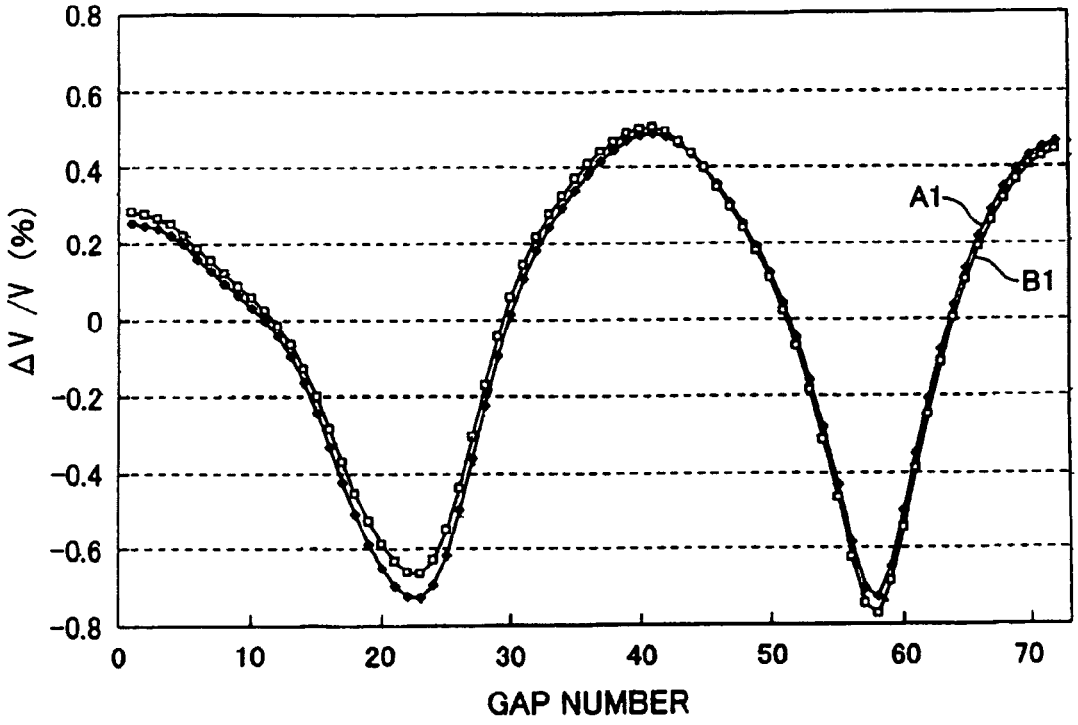
FIG. 10 is a graph showing a voltage change when the tuners T4, T12 are used as auto-tuners.

A voltage change in the combinations of the two tuners T4, T12 and the respective insertion amounts of the two tuners T4, T12 was calculated. FIG. 10 is a graph showing a voltage change occurring when the tuner T4 has an insertion amount X of 6.67 mm (insertion distance d of 16.67 mm), and the tuner 12 has an insertion amount X of 10.00 mm (insertion distance d of 20.00 mm). In FIG. 10, the curve A1 indicates a voltage change obtained by adding the respective voltage changes of the two tuners T4, T14. As shown in FIG. 10, a variation width of ΔV/V was 1.2% in the entire resonator, i.e., a maximum width of voltage change was 1.2%.

Then, a model having the two tuners T4, T14 simultaneously inserted was prepared, and a voltage change in the model was calculated using a direct three-dimensional electromagnetic field calculation code. The curve B1 in FIG. 10 indicates the calculation result. As seen in FIG. 10, the voltage change obtained by adding the respective voltage changes of the two tuners almost conforms to the voltage change calculated through the direct three-dimensional electromagnetic field calculation.

Table 1 shows parameters indicative of characteristics of the resonator, such as a resonant frequency, a quality factor (Q), a shunt impedance and a required power, obtained through a direct three-dimensional electromagnetic field calculation. As shown in Table 1, a change in resonant frequency was 81 KHz (0.081 MHz). There was substantially no change in the remaining parameters. Thus, it is proven that only a resonant frequency can be adjusted using the combination of auto-tuners, without exerting an influence on a voltage distribution and other characteristics of the resonator. In Table 1, an original model means a model having the two tuners at a non-inserted position, i.e., at the reference position.

TABLE 1

| Parameter | Original Model | Model after Insertion of Tuners | Difference |
|---|---|---|---|
| resonant frequency (MHz) | 200.103 | 200.184 | 0.081 |
| Q | 16054 | 16022 | −32.000 |
| shunt impedance (MΩ/m) | 111.64 | 111.37 | −0.269 |
| required power (KW) | 365.00 | 365.90 | 0.899 |

(2) Combination of Three Tuners

As a second example, three of the tuners are combined to cancel out respective voltage changes attributed thereto. For this purpose, a program-based search was performed in the same manner as that in the first example for the combination of two tuners. As a result, a combination of three tuners and a combination of respective insertion amounts of the three tuners which provided a minimum voltage change were satisfied when the tuners T3, T9, T16 were inserted at a ratio of 5.40:7.60:10.00.

Figure 11:
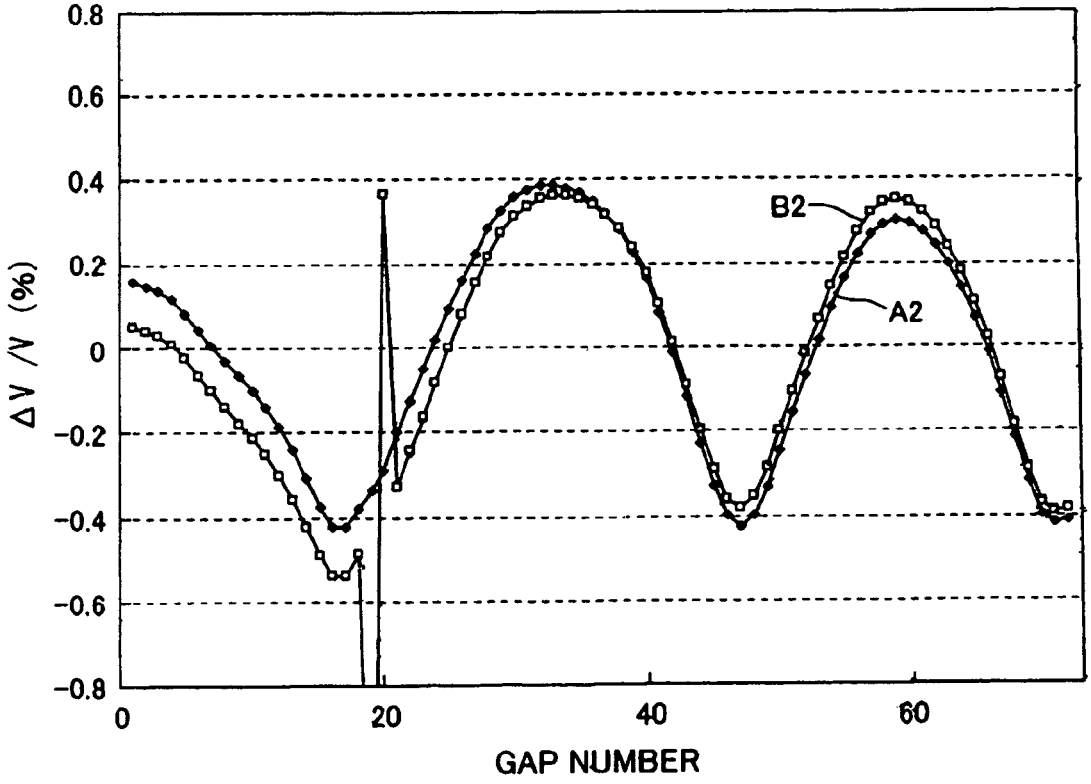
FIG. 11 is a graph showing a voltage change when the tuners T3, T9, T16 are used as auto-tuners.

FIG. 11 is a graph showing a voltage change occurring when the three tuners T3, T9, T16 have an insertion amount X of 5.40 mm (insertion distance d of 15.40 mm), an insertion amount X of 7.60 mm (insertion distance d of 17.60 mm) and an insertion amount X of 10.00 mm (insertion distance d of 20.00 mm), respectively. In FIG. 11, the curve A2 indicates a voltage change obtained by adding the respective voltage changes of the three tuners T3, T9, T16. As a result, a maximum width of voltage change was 0.81%, which is about 30% smaller than that in the combination of two tuners illustrated in FIG. 10.

Then, a voltage change in a model based on the combinations of the three tuners T3, T9, T16 and the respective insertion amounts of the three tuners T3, T9, T16 was calculated using a direct three-dimensional electromagnetic field calculation code. The curve B2 in FIG. 11 indicates the calculation result. A sharp peak around the gap number 20 in the curve B2 would result from calculation accuracy (setting of a calculation mesh). As seen in FIG. 11, the voltage change obtained by adding the respective voltage changes of the three tuners almost conforms to the voltage change calculated through the direct three-dimensional electromagnetic field calculation.

Table 2 shows parameters indicative of characteristics of the resonator, such as a resonant frequency, a quality factor (Q), a shunt impedance and a required power, obtained through a direct three-dimensional electromagnetic field calculation. As shown in Table 2, a change in resonant frequency was 95 KHz (0.095 MHz). There was substantially no change in the remaining parameters. Thus, it is proven that only a resonant frequency can be adjusted using the combination of auto-tuners, without exerting an influence on a voltage distribution and other characteristics of the resonator. In Table 2, an original model means a model having the three tuners at a non-inserted position, i.e., at the reference position.

TABLE 2

| Parameter | Original Model | Model after Insertion of Tuners | Difference |
|---|---|---|---|
| resonant frequency (MHz) | 200.103 | 200.198 | 0.095 |
| Q | 16054 | 16054 | 0.000 |
| shunt impedance (MΩ/m) | 111.64 | 111.59 | −0.045 |
| required power (KW) | 365.00 | 365.27 | 0.271 |

Then, in the model illustrated in FIG. 11, the tuner was retracted from the reference position by the same amount to lower the frequency. That is, the three tuners T3, T9, T16 were set to have an insertion amount X of −5.40 mm (insertion distance d of 4.60 mm), an insertion amount X of −7.60 mm (insertion distance d of 2.40 mm) and an insertion amount X of −10.00 mm (insertion distance d of 0.00 mm), respectively. The curve A3 in FIG. 12 indicates a voltage change in this case, and the curve B3 indicates a voltage change calculated using a direct three-dimensional electromagnetic field calculation code.

Table 3 shows parameters indicative of characteristics of the resonator, such as a resonant frequency, a quality factor (Q), a shunt impedance and a required power, obtained through a direct three-dimensional electromagnetic field calculation in the above case. As shown in Table 3, a change in resonant frequency was −75 KHz (0.075 MHz). There was substantially no change in the remaining parameters. As seen in Table 3, when the three tuners are retracted even in the same combination, an amount of frequency change is less than that when the three tuners are inserted. The reason would be that the three tuners during retraction are hidden behind the remaining tuners. In Table 3, an original model means a model having the three tuners at a non-inserted position, i.e., at the reference position.

TABLE 3

| Parameter | Original Model | Model after Insertion of Tuners | Difference |
|---|---|---|---|
| resonant frequency (MHz) | 200.103 | 200.028 | −0.075 |
| Q | 16054 | 16085 | 31.000 |
| shunt impedance (MΩ/m) | 111.64 | 111.89 | 0.256 |
| required power (KW) | 365.00 | 364.10 | −0.898 |

Figure 12:
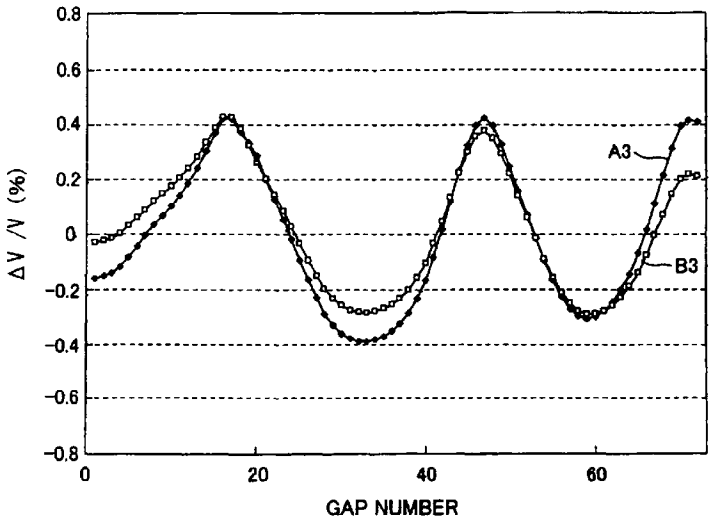
FIG. 12 is a graph showing a voltage change when each of the tuners T3, T9, T16 used as auto-tuners is retracted by the same insertion amount as that in FIG. 11 symmetrically with respect to a reference position (insertion distance=10 mm)
Figure 13:
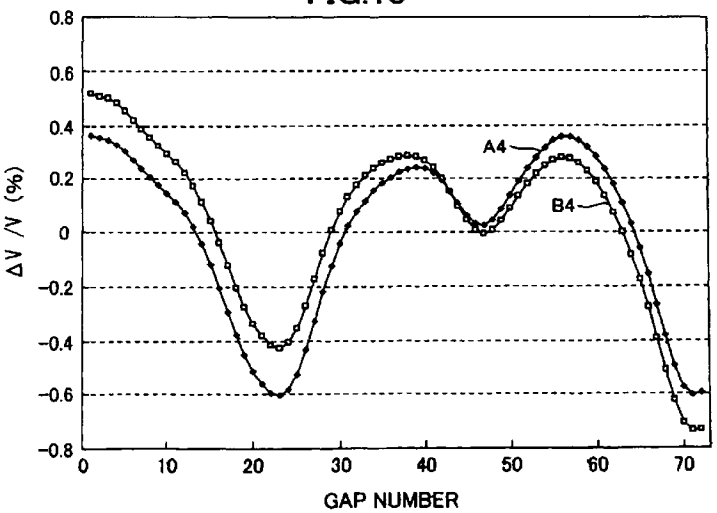
FIG. 13 is a graph showing a voltage change when the tuners T4, T9, T16 are used as auto-tuners.

The following discussion will be made about a third example where three tuners other than those in FIGS. 11 and 12 are used as auto-tuners. When the tuners T3, T9, T16 are used as auto-tuners, the linac is insufficient in terms of a symmetry property, as shown in FIG. 1. Thus, in view of a symmetry property, a calculation was performed for a linac using the tuners T4, T9, T16 as auto-tuners. As a result of a program-based search, when the tuners T4, T9, T16 were inserted at a ratio of 5.85:4.54:10.00, a voltage change in the entire resonator was minimized. FIG. 13 is a graph showing a voltage change occurring when the three tuners T4, T9, T16 have an insertion amount X of 5.85 mm (insertion distance d of 15.85 mm), an insertion amount X of 4.54 mm (insertion distance d of 14.54 mm) and an insertion amount X of 10.00 mm (insertion distance d of 20.00 mm), respectively.

In FIG. 13, the curve A4 indicates a voltage change obtained by adding the respective voltage changes of the three tuners T4, T9, T16. As a result, a maximum width of voltage change was 0.97%. The curve B4 in FIG. 13 indicates a voltage change calculated using a direct three-dimensional electromagnetic field calculation code. As seen in FIG. 13, the voltage change obtained by adding the respective voltage changes of the three tuners almost conforms to the voltage change calculated through the direct three-dimensional electromagnetic field calculation.

Table 4 shows parameters indicative of characteristics of the resonator, such as a resonant frequency, a quality factor (Q), a shunt impedance and a required power, obtained through a direct three-dimensional electromagnetic field calculation in the third example. As shown in Table 4, a change in resonant frequency was 79 KHz (0.079 MHz). There was substantially no change in the remaining parameters. Thus, it is proven that only a resonant frequency can be adjusted using the combination of auto-tuners, without exerting an influence on a voltage distribution and other characteristics of the resonator. In Table 4, an original model means a model having the three tuners at a non-inserted position, i.e., at the reference position.

TABLE 4

| Parameter | Original Model | Model after Insertion of Tuners | Difference |
|---|---|---|---|
| resonant frequency (MHz) | 200.103 | 200.182 | 0.079 |
| Q | 16054 | 16033 | −21.000 |
| shunt impedance (MΩ/m) | 111.64 | 111.40 | −0.239 |
| required power (KW) | 365.00 | 365.67 | 0.664 |

A calculation was also performed for a linac using a combination of the tuners T2, T9, T16 as auto-tuners. As a result, a voltage change had a positive peak of 0.8% and a negative peak of −0.6%. i.e., a maximum width of voltage change was 1.4%, which is greater than those in the aforementioned combinations.

The following description will be made about a temperature correction range based on auto-tuners selected by a process according to one embodiment of the present invention. The resonator typically has a resonant frequency $f_0$ of 200 Hz. The resonator is made of iron having a linear expansion coefficient $\alpha$ of $1.18\times10^{-5}$. Thus, a resonant frequency change $\Delta f$ per degree in temperature t is calculated as follows:

$$\Delta f = \alpha t f_0$$
$$= 1.18\times10^{-5}\times1\times200 \text{ [MHz]}$$
$$= 2.36 \text{ [KHz]}$$

In the aforementioned second example where the three tuners T3, T9, T16 used as auto-tuners have an insertion amount X of 5.40 mm (insertion distance d of 15.40 mm), an insertion amount X of 7.60 mm (insertion distance d of 17.60 mm) and an insertion amount X of 10.00 mm (insertion distance d of 20.00 mm), respectively, an increase in resonant frequency was about 95 KHz. Thus, a temperature correction range ΔC in the insertion amounts of the tuners is as follows:

$$\Delta C = 95 \text{ [KHz]}/2.36 \text{ [KHz]} = 40 \text{ [degree]}$$

When the tuners are retracted from the reference position in the second example [where the three tuners T3, T9, T16 were set to have an insertion amount X of −5.40 mm (insertion distance d of 4.60 mm), an insertion amount X of −7.60 mm (insertion distance d of 2.40 mm) and an insertion amount X of −10.00 mm (insertion distance d of 0.00 mm), respectively], the resonant frequency was lowered by 75 KHz. Thus, the temperature correction range ΔC is as follows:

$$\Delta C = 75 \text{ [KHz]}/2.36 \text{ [KHz]} = 32 \text{ [degree]}$$

As above, considering only the insertion amounts, the temperature correction range extends from −32 degrees to +40 degrees. It can be said that this correction range is sufficient from a practical standpoint.

Thus, a tuner insertion amount per degree is 5.4 [mm]/40 [degree]=0.14 [mm/degree] at a minimum. In a control for 0.1 degree in temperature, a moving step during insertion of the tuner is 0.014 [mm/step]=14 [μm/step]. This value falls within a range adequately controllable by a stepping motor.

As mentioned above, in the method according to the embodiment of the present invention, it is verified whether the linearity of a voltage change to an insertion amount of the inductive tuner is adequate. Then, a voltage change in a combination of two or more of a plurality of tuners can be estimated by calculating respective voltage changes attributed to the plurality of tuners and adding the voltage changes of the two or more tuners. A voltage change occurring when respective insertion amounts of the two or more tuners are increased without changing a ratio between the respective insertion amounts of the two or more tuners can also be estimated. Then, a model having the two or more tuners simultaneously inserted is prepared, and a voltage change in the model is calculated using a three-dimensional electromagnetic field calculation code, to verify whether the calculated voltage change adequately conforms to the estimated voltage change in the combination of two or more tuners.

In the specific examples based on the method according to the embodiment of the present invention, a calculation was performed for total four combinations: one combination of two tuners; and three combinations of three tuners. In either example, a voltage change could be reduced within ±0.8%. Among the four combinations, the combination of the tuners T3, T9, T16 had a minimum voltage change, and the voltage change was reduced to slightly more than ±0.4%. The combination of the tuners T3, T9, T16 provided a sufficient temperature correction range of −32 to +40 degrees, even during insertion thereof. Thus, in the above examples, the combination of the tuners T3, T9, T16 is most suitable as auto-tuners.

Figure 14:
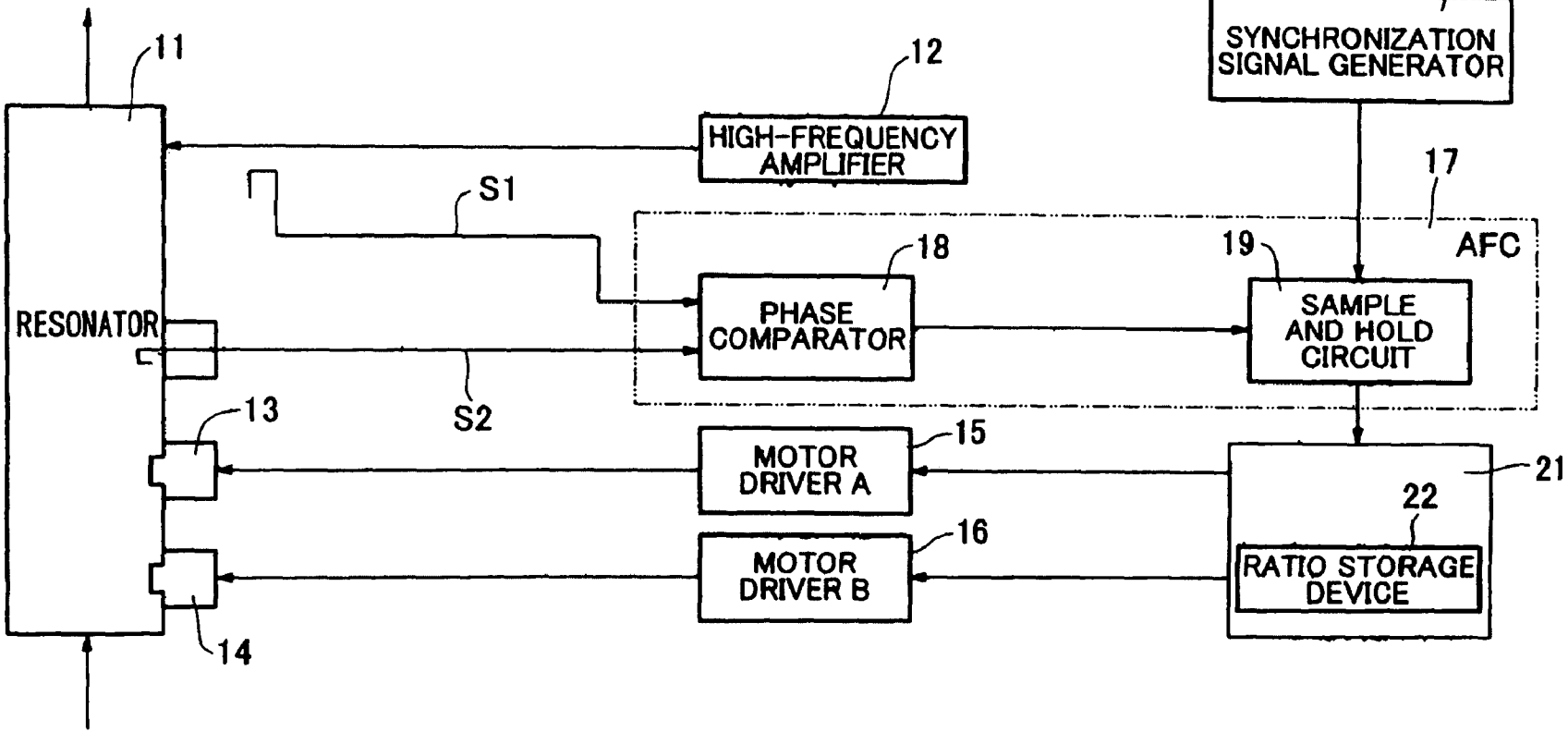
FIG. 14 is an explanatory block diagram schematically showing a mechanism for correcting a resonant frequency of a resonator.

A method of correcting a resonant frequency of a resonator using auto-tuners selected by the process according to the embodiment of the present invention will be briefly described below. FIG. 14 is an explanatory block diagram schematically showing a mechanism for correcting a resonant frequency of a resonator. In FIG. 14, an ion beam is input into a resonator 11 as indicated by the arrow. Then, the ion beam is accelerated inside the resonator by a high-frequency power supplied through a high-frequency amplifier 12, and output from the resonator 11 as indicated by the arrow. The resonator 11 is provided with two auto-tuners 13, 14 consisting of auto-tuners A, B selected by the process according to the embodiment of the present invention. Each of the auto-tuners is designed to be driven by a stepping motor (not shown), and a driving signal is sent to each of the stepping motors through a corresponding one of two motor drivers 15, 16 consisting of motor drivers A, B.

As shown in FIG. 14, an automatic frequency control (AFC) device 17 is provided as a means to correct a slight resonant frequency shift in the resonator. The AFC device 17 comprises a phase comparator 18 adapted to compare a traveling wave S1 from the high-frequency amplifier 12 with a monitoring signal picked up in an acceleration cavity of the resonator 11, and output a phase difference therebetween, and a sample and hold circuit 19 adapted to sample and hold the phase difference. Specifically, a synchronization signal generated from an external synchronization signal generator 20 is input into the AFC device 17, and the sample and hold circuit 19 is operable, in response to receiving the synchronization signal, to sample and hold a value of the phase difference.

The phase difference detected by the AFC device 17 is sent to a sequencer 21. The sequencer 21 is operable to send a control signal to the motor drivers A, B so as to adjust respective insertion amounts of the auto-tuners A, B depending on the phase difference. In the present invention, the respective insertion amounts of the auto-tuners A, B are adjusted without changing a ratio between the respective insertion amounts which is obtained during the process of selecting the auto-tuners. Specifically, given that the auto-tuners A, B are the tuners T4, T12, respectively, as in the aforementioned first example about the selection process for a combination of two tuners, the sequencer 21 is operable to ad just the respective insertion amounts of the auto-tuners A, B without changing the ratio of the insertion amount of the auto-tuner A to the insertion amount of the auto-tuner B, i.e., 6.67:10.00. For example, when the insertion amount of the auto-tuner A is adjusted to increase twofold, the insertion amount of the auto-tuner B is also adjusted to increase twofold. As a result, the voltage change will be increased in a linear relation to an increase in the insertion amount, and therefore the maximum width of voltage change can be estimated to be double, i.e., 2.4%. Thus, this adjustment method makes it possible to correct the resonant frequency while maintaining the voltage distribution in the resonator in an allowable range.

The sequencer 21 is provided with a ratio storage device 22 for storing the ratio of the insertion amount of the auto-tuner A to the insertion amount of the auto-tuner B. The sequencer 21 is operable to issue a control instruction for the respective motor drivers A, B to generate pulses corresponding to the detected phase difference in such a manner as to keep the insertion-amount ratio stored in the ratio storage device 22 from being changed. The motor drivers A, B are operable, in response to receiving the control instruction, to drive the corresponding tuners A, B through the corresponding stepping motors.

In the embodiment illustrated in FIG. 14, the sequencer is used as insertion-amount adjustment means. Alternatively, a personal computer may be used in place of the sequencer. While the AFC device in the embodiment illustrated in FIG. 14 is provided separately from the sequencer and the motor drivers, the sequencer and/or the motor drivers may be integrated with the AFC device. Further, while the number of auto-tuners used in the embodiment illustrated in FIG. 14 is two, the number of auto-tuners to be used in the present invention may be three or more. For example, in the aforementioned second example about the selection process for the optimal combination of the tuners T3, T9, T16, the insertion-amount ratio of the tuner T3:the tuner T9:the tuner T16 is 5.40:7.60:10.00. Thus, in this example, the respective insertion amounts of the tuners T3, T9, T16 will be adjusted without changing this insertion-amount ratio.

Figure 15:
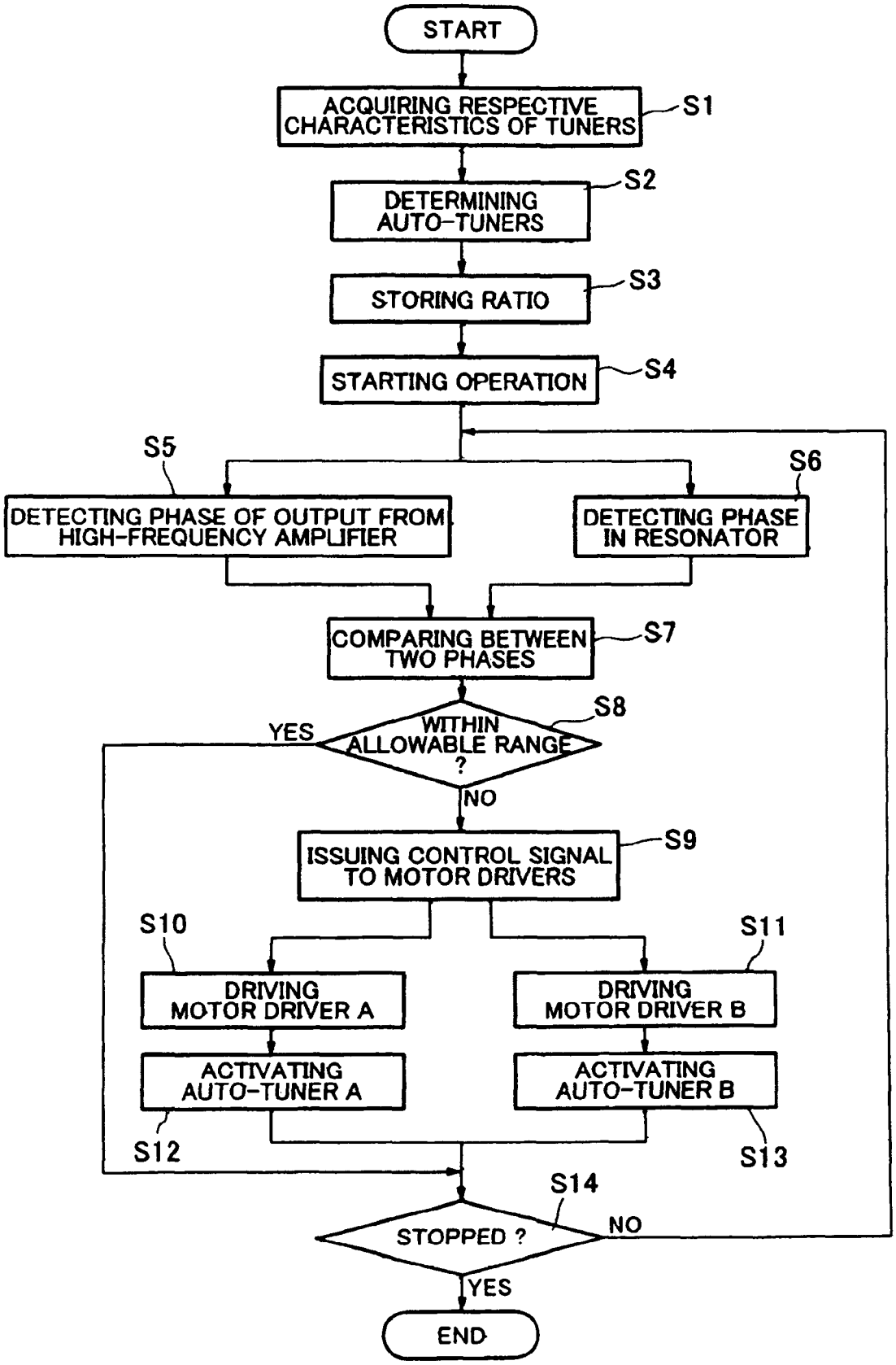
FIG. 15 is a flowchart showing a process of selecting auto-tuners and a process of correcting a resonant frequency using the selected auto-tuners, according to one embodiment of the present invention.

FIG. 15 is a flowchart showing a process of selecting auto-tuners and a process of correcting a resonant frequency using the selected auto-tuners, according to one embodiment of the present invention. In this embodiment, in Step S1, respective characteristics of the plurality of tuners are acquired. This processing is performed by verifying a linearity of a voltage change to a tuner insertion amount, and calculating voltage change data corresponding respective insertion amounts, for each of the plurality of tuners, through a proportional calculation based on the voltage change linearity, as described above. Then, in Step S2, two auto-tuners are determined based on the acquired data about the plurality of tuners. This processing is performed by determining a combination of tuners suitable for auto-tuners and a combination of respective insertion amounts of the tuners, according to a program-based search, and verifying the determination result through a direct three-dimensional electromagnetic field calculation, as described above. Then, in Step S3, an insertion-amount ratio is stored. This processing is performed by storing the verified insertion amounts of the tuners in the ratio storage device of the sequencer. The processings in Steps S1 and S2 will be more specifically described with reference to FIG. 16.

After selecting auto-tuners in the above manner, in Step S4, an operation of the linac is initiated. During the linac operation, a high-frequency power is supplied to the resonator 11 through the high-frequency amplifier 12 to maintain the cavity of the resonator 11 in a resonant condition. In Steps S5 and S6, a phase of an output from the high-frequency amplifier and a phase inside the resonator are monitored. If a resonant frequency is changed due to a change in temperature of the resonator, the monitored phases are compared with each other to output a phase difference, in Step S7. Then, in Step S8, it is determined whether or not the phase difference falls within an allowable range. If the phase difference is out of the allowable range, the routine advances to Step S9 to correct the resonant frequency. This correction processing is performed by sending a control signal to the motor drivers A, B so as to adjust the respective insertion amounts of the auto-tuners A, B depending on the phase difference. The respective insertion amounts of the auto-tuners A, B are adjusted without changing the ratio of the insertion amount of the auto-tuner A to the insertion amount of the auto-tuner B stored in Step S3.

In Steps S10 and S11, in response to receiving the control signal, each of the motor drivers A, B controls a corresponding one of the stepping motors. According to the control of the motor drivers A, B, the auto-tuners A, B are activated to correct the resonant frequency. After completion of the correction, the routine advances to Step S14 to determine whether the linac operation is stopped. In Step S8, when it is determined that the phase difference falls within the allowable range, the routine also advances to Step 14. In Step S14, if it is determined that the linac operation is continued, the routine will return to the process flow just after Step S4 to repeat the subsequent Steps. In Step S14, when it is determined that the linac operation is stopped, the routine is terminated.

Figure 16:
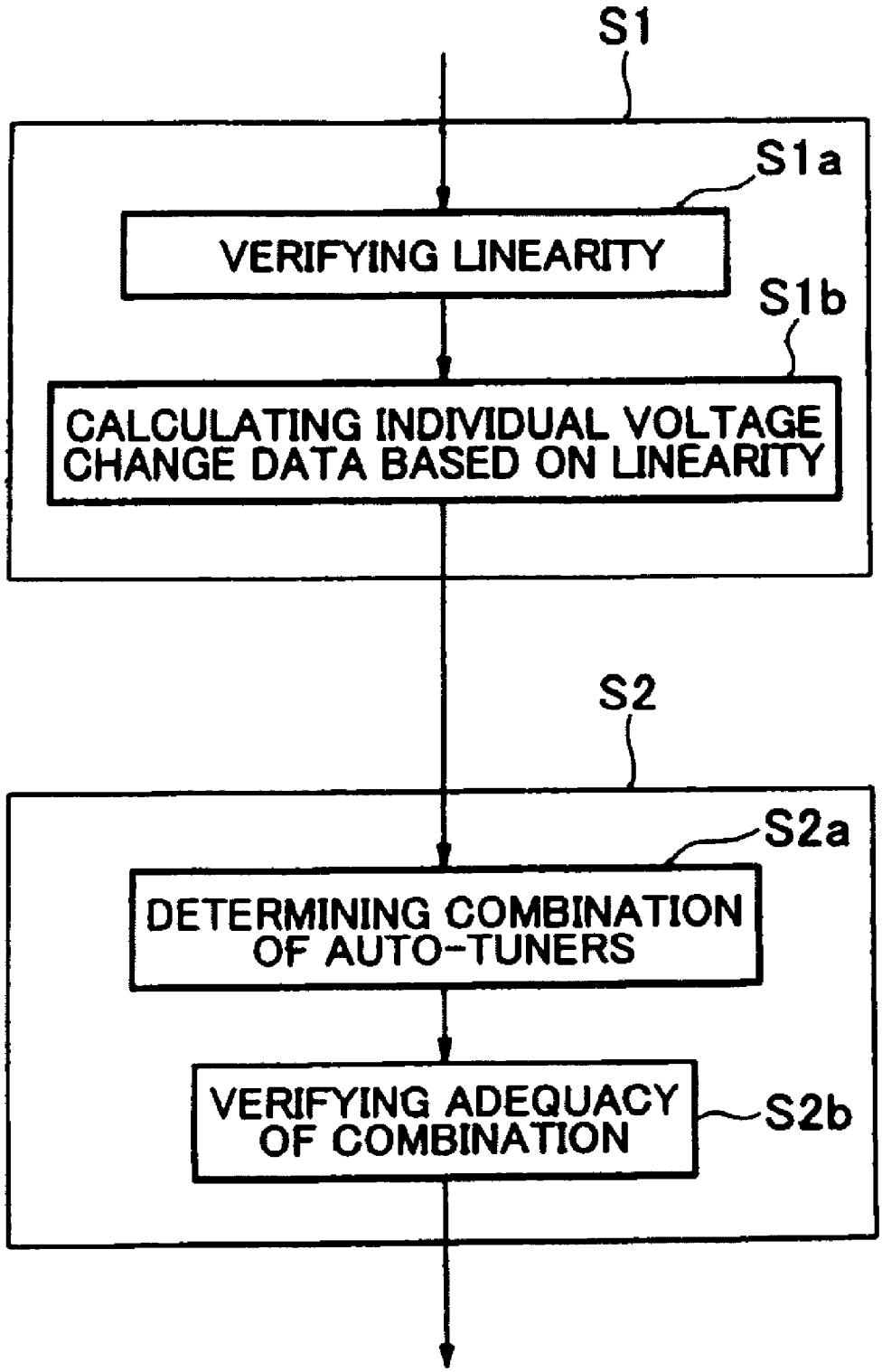
FIG. 16 is a flowchart specifically showing the auto-tuner selection process according to the embodiment.

The auto-tuner selection process according to the embodiment of the present invention comprises Steps S1 and S2 in FIG. 15. FIG. 16 is a flowchart more specifically showing the auto-tuner selection process. As shown in FIG. 16, Step S1 includes Step S1*a* and Step S1*b*. In Step S1*a*, a linearity of a voltage change to a tuner insertion amount is first verified. Specifically, an insertion amount of a nominated one of the tuners is changed, and voltage changes corresponding to the respective insertion amounts are calculated through a three-dimensional electromagnetic field calculation. The voltage changes are plotted to create a graph, and the linearity of a voltage change to a tuner insertion amount is verified based on the graph. Then, in Step S1*b*, based on the voltage change linearity, voltage change data corresponding respective insertion amounts are calculated for each of the plurality of tuners through a proportional calculation. Specifically, a voltage corresponding to a certain insertion amount, e.g., an insertion amount of 10 mm, is calculated for each of the plurality of tuners through a three-dimensional electromagnetic field calculation. Then, based on the calculation result, voltage change data corresponding to the remaining insertion amounts are calculated for each of the plurality of tuners. In the above manner, a process of acquiring respective characteristics of the plurality of tuners, i.e., a process of acquiring voltage change data corresponding to respective insertion amounts, for each of the plurality of tuners, is completed.

As shown in FIG. 16, Step 2 includes Step S2*a* and Step S2*b*. In Step S2*b*, auto-tuners A, B are determined based on the acquired data about the plurality of tuners. This processing is performed by determining a combination of tuners suitable for auto-tuners and a combination of respective insertion amounts of the tuners, according to a program-based search, as described above. Specifically, according a program-based search, a combination of nominated tuners and a combination of respective insertion amounts of the nominated tuners are determined on a condition that, when the individual voltage change data of the nominated tuners are added together, respective voltage changes attributed to the nominated tuners are cancel led out to allow an entire voltage distribution to have substantially no change. Then, in Step S2*b*, it is verified whether the determined combinations are adequate, through a direct three-dimensional electromagnetic field calculation. Through the verification, the nominated tuners are finally selected as auto-tuners. In the above manner, a combination of auto-tunes and a combination of respective insertion amounts of the auto-tuners are adequately determined.

What is claimed:

1. A method of designing an H-mode drift-tube linac utilizing a TE wave (H mode) generated inside a resonator, said method comprising:

nominating at least two tuners from among a plurality of tuners arranged along an axial direction of said resonator; and selecting said nominated tuners as auto-tuners through evaluation in terms of whether only a frequency is changed without changing a voltage distribution in said resonator, using a combination of respective positions of said nominated tuners in the axial direction of said resonator and respective insertion amounts of said nominated tuners into said resonator.

2. The method as defined in claim 1, wherein said step of selecting includes:

calculating or measuring individual voltage change data corresponding to respective insertion amounts, for each of said plurality of tuners, based on a given relationship between a tuner insertion amount and a voltage change; and determining a combination of at least two auto-tuners and a combination of respective insertion amounts of said at least two auto-tuners, using said individual voltage change data.

3. The method as defined in claim 2, which said step of selecting further includes the sub-step of verifying said given relationship between a tuner insertion amount and a voltage change.

4. The method as defined in claim 2, which said step of selecting further includes the sub-step of verifying whether said determined combinations are adequate.

5. The method as defined in claim 2, wherein said given relationship is a linear relationship between a tuner insertion amount and a voltage change, wherein said individual voltage change data corresponding to respective insertion amounts, for each of said plurality of tuners, are calculated through a proportional calculation based on said linear relationship.

6. The method as defined in claim 2, wherein said sub-step of determining a combination of at least two auto-tuners and a combination of respective insertion amounts of said at least two auto-tuners comprises determining said combinations on a condition that, when the individual voltage change data of said nominated tuners are added together, respective voltage changes attributed to said nominated tuners are cancelled out to allow an entire voltage distribution to have substantially no change.

7. An H-mode drift-tube linac utilizing a TE wave (H mode) generated inside a resonator, said linac comprising a plurality of tuners which are arranged along an axial direction of said resonator, and partly used as an auto-tuner, wherein:

said auto-tuner consists of at least two tuners which are nominated from among said plurality of tuners, and selected through evaluation in terms of whether only a frequency is changed without changing a voltage distribution in said resonator, using a combination of respective positions of said nominated tuners in the axial direction of said resonator and respective insertion amounts of said nominated tuners into said resonator.

8. The H-mode drift-tube linac as defined in claim 7, which includes insertion-amount adjustment means adapted to adjust respective insertion amounts of said selected at least two auto-tuners without changing a ratio between said respective insertion amounts.

9. The H-mode drift-tube linac as defined in claim 8, wherein said insertion-amount adjustment means includes storage means adapted to store said ratio between the respective insertion amounts of said at least two auto-tuners.

10. An auto-tuner selection process for use in a method of designing an H-mode drift-tube linac utilizing a TE wave (H mode) generated inside a resonator, said process comprising:

nominating at least two tuners from among a plurality of tuners arranged along an axial direction of said resonator; and selecting said nominated tuners as auto-tuners through evaluation in terms of whether only a frequency is changed without changing a voltage distribution in said resonator, using a combination of respective positions of said nominated tuners in the axial direction of said resonator and respective insertion amounts of said nominated tuners into said resonator.

11. A method of adjusting at least two auto-tuners employed in an H-mode drift-tube linac utilizing a TE wave (H mode) generated inside a resonator, said auto-tuners being selected by nominating at least two tuners from among a plurality of tuners arranged along an axial direction of said resonator, and evaluating said nominated tuners in terms of whether only a frequency is changed without changing a voltage distribution in said resonator, using a combination of respective positions of said nominated tuners in the axial direction of said resonator and respective insertion amounts of said nominated tuners into said resonator, said method comprising adjusting respective insertion amounts of said auto-tuners without changing a ratio between said respective insertion amounts.

* * * * *